US006185819B1

(12) United States Patent
Bauer et al.

(10) Patent No.: US 6,185,819 B1
(45) **Date of Patent: *Feb. 13, 2001**

(54) CATALYTIC CONVERTER HOUSING ARRANGEMENT

(75) Inventors: Helmut Bauer, Espenau; Olaf Herden, Kassel; Werner Harsch; Robert Siebert, both of Baunatal, all of (DE)

(73) Assignee: Volkswagen AG, Wolfsburg (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/891,052

(22) Filed: Jul. 10, 1997

(30) Foreign Application Priority Data

Jul. 10, 1996 (DE) ..... 196 27 705

(51) Int. Cl.[7] ..... B23P 15/00; F01N 3/28

(52) U.S. Cl. ..... 29/890; 422/177; 422/179; 422/180

(58) Field of Search ..... 422/171–180; 60/299, 300; 29/890, 428

(56) References Cited

U.S. PATENT DOCUMENTS

| | | | | |
|---|---|---|---|---|
| 3,975,826 | * | 8/1976 | Balluff | 422/179 |
| 4,087,039 | | 5/1978 | Balluff | 29/515 |
| 4,093,423 | | 6/1978 | Neumann | 60/299 |
| 4,163,042 | | 7/1979 | Lynch | 422/179 |
| 4,969,264 | | 11/1990 | Dryer et al. | 422/179 |
| 5,118,476 | | 6/1992 | Dryer et al. | 422/179 |
| 5,173,267 | * | 12/1992 | Maus et al. | 422/179 |
| 5,174,969 | * | 12/1992 | Fisher et al. | 422/180 |
| 5,190,732 | * | 3/1993 | Maus et al. | 422/179 |
| 5,229,080 | * | 7/1993 | Abe et al. | 422/177 |
| 5,585,073 | * | 12/1996 | Swars et al. | 422/180 |

FOREIGN PATENT DOCUMENTS

| | | |
|---|---|---|
| 3430398 | 2/1986 | (DE) . |
| 3430399 | 2/1986 | (DE) . |
| 3729994 | 3/1989 | (DE) . |
| 3821397 | 12/1989 | (DE) . |
| 4223648 | 1/1994 | (DE) . |
| 243951 | 11/1987 | (EP) . |
| 263893 | 4/1988 | (EP) . |
| 336115 | 10/1989 | (EP) . |
| 425983 | 5/1991 | (EP) . |
| 681095 | 11/1995 | (EP) . |
| 768451 | 4/1997 | (EP) . |
| 818615 | 1/1998 | (EP) . |

* cited by examiner

*Primary Examiner*—Hien Tran
(74) *Attorney, Agent, or Firm*—Baker Botts L.L.P.

(57) ABSTRACT

A catalytic converter housing arrangement includes inlet and outlet funnels having large diameter ends mounted by connection bevels at the ends of a wound metal sheet forming a tubular central part of the catalytic converter and welded to the bevels. The funnels are produced from tubular blanks by expanding one end and drawing in the other end. This results in a significant reduction in weight compared with funnels which are deep-drawn from sheet-metal blanks.

6 Claims, 1 Drawing Sheet

CATALYTIC CONVERTER HOUSING ARRANGEMENT

BACKGROUND OF THE INVENTION

This invention relates to catalytic converter housings having a tubular central part and funnels connecting the central part to inlet and outlet pipes.

There are many different arrangements for catalytic converter housings which are used to mount a catalytic converter in the exhaust system of an internal combustion engine, especially for motor vehicles, and two arrangements have become established in the market. In the first arrangement, an expanded mat is wrapped around a monolith of ceramic or metallic design which is coated with a catalytically active material, the expanded mat being effective to support the monolith. A sheet-metal jacket is, in turn, placed on this expanded mat and is wound with a predetermined force, thereby holding the monolith in position. The tensioned sheet-metal jacket is tacked at its seam to form a tube so that the monolith is seated in a fixed manner. Inlet and outlet funnels are attached by circular welds at the ends of the tube and are aligned in accordance with the requirements for attachment to the exhaust pipe. After closing the tubular sheet-metal jacket by welding the seam, the finished wound converter is completed. Despite the high functional and process reliability of such wound converters, disadvantages have been found when they are used as standard fittings. One disadvantage is the high weight of the assembly and the other is that the funnels are often connected to the monolith surfaces in a way which interferes with the flow of exhaust gas through the monolith.

Another commercial arrangement for a catalytic converter housing, called the shell converter, avoids these disadvantages. In contrast to the wound converter, the shell converter consists of a monolith, an impregnated expanded mat, and two half-shells i.e., an upper half shell and a lower half shell. However, the shell converter has inadequate process reliability and, in addition, the geometry required by the shell form presents difficulties in fitting it to the undersurfaces of motor vehicles. Where there are variations in the shapes of the undersurfaces of motor vehicles, it is necessary to compensate for a difference in the exhaust pipe converter connection by a complex and thus costly pipe adaptation arrangement.

During the assembly of the shell converter, the expanded mat is dipped into an organic fluid to allow it to be installed more easily. This organic fluid subsequently evaporates, leaving the expanded mat very porous. Moreover, when the assembled converter is subjected to thermal loading, the converter shell expands to a very different extent than the monolith so that manufacture within very narrow tolerances is necessary for reliable functioning of the shell converter. If the narrow tolerances are not maintained, clearances open up, permitting movement of the monolith in the housing after the motor vehicle has been put into operation, and these can lead to failure of the catalytic converter. Such catalytic converter housing arrangements are known, for example, from German Patents Nos. 42 23 648, 38 21 397 and 38 11 224 and German Offenlegungsschrift No. 37 29 994.

A further difficulty in the assembly of the catalytic converter housing is encountered in the connection of a funnel to the tubular housing body. The funnel, which is provided to compensate for the differences in diameter between the inlet and outlet pipes and the tubular converter body, is intended, on the one hand, to ensure a controlled flow of exhaust gas and, on the other hand, to protect the expanded mat from being eroded by the pulsating flow of exhaust gas. For this purpose, the funnel collar is usually set at an angle of 90° to the funnel axis, as shown, for example, in FIG. 5 of German Offenlegungsschrift No. 34 30 398.

Such funnels are usually produced from a sheet-metal blank by deep-drawing, but this results in two problems. On the one hand, the sheet-metal blanks have to be thick enough to provide sufficient thickness at the small end diameter after deep drawing to permit welding of the small end diameter to the exhaust pipe. The second problem origi nates from the 90° positioning of the funnel opening relative to the funnel collar which is welded to the catalytic converter housing. In this case, depending on the position of the monolith diameter in its tolerance range within the tubular central part and any off-center fastening of the funnel collar to the catalytic converter housing, it may happen that an effective monolith area of up to 15% is covered by the funnel. An improvement in this regard is provided by the funnel connection shown in FIG. 1 of German Offenlegungsschrift 34 30 398, in which there is only a slight overlap of the funnel with the effective monolith end face. However, this connection requires high precision in the manufacture of the housing components and of the funnel since, otherwise, the funnel cannot be inserted into the housing with an accurate fit.

This becomes even more problematic because of the welding of three layers of sheet metal 1, 2, and 10 to the inlet funnel in the arrangement shown in FIG. 1 of German Offenlegungsschrift No. 3430398.

A further funnel connection is disclosed in German Offenlegungsschrift No. 34 30 399, in which the large diameter end of the funnel is folded over the catalytic converter housing. However, this is a very complicated process and does not remove the disadvantage of partial covering of the effective converter end face.

SUMMARY OF THE INVENTION

Accordingly, it is an object of the present invention to provide a catalytic converter housing arrangement which overcomes the above-mentioned disadvantages of the prior art.

Another object of the invention is to provide a catalytic converter housing arrangement which, on the one hand, has a low weight and, on the other hand, has a favorable exhaust-gas flow path.

These and other objects of the invention are attained by providing a catalytic convertor having a tubular central part and having inlet and outlet funnel parts which are formed from tubular members by expanding the tubular member at one end to the diameter required to fit the tubular central part and reducing the tubular member at the other end to the diameter required to fit the exhaust pipe. The reduction in of the diameter of the tube is preferably accomplished by pressing, i.e. drawing, the tubular member into a die.

For a simple production process, the tubular funnel is manufactured in two stages, the expansion of one end following the drawing in of the other end or vice versa. This method makes it possible to provide a tubular blank for the funnel having precisely the thickness required to produce the necessary thickness for welding of the enlarged funnel end.

According to the invention, the funnel has at its large diameter end a thickness of material which is no more than 90% of the thickness of material at its small diameter end. Preferably, the thickness of the material at the large diameter end is no more than 80% of that at the small end. However, the thickness of the material at the large diameter end is at least 40%, and preferably at least 60%, of the thickness of the material at the small diameter end. Otherwise, the funnel would be too heavy and weld ability would be a problem either at the large diameter end or at the small diameter end. With this thickness distribution for the funnel, it is thus possible not only to configure the funnel with an optimized weight but also to configure it in such a way that it is readily weldable at both ends. As a result, the tubular central converter jacket can be welded without difficulty to the large diameter end of each funnel and the exhaust pipe can be welded without difficulty to the small diameter end of each funnel.

In contrast, the funnels produced in accordance with the prior art have an opposite weight distribution, i.e. the large diameter end has a larger wall thickness than the small diameter end causing these funnels to be considerably heavier.

Producing the tubular funnels by expansion of the large diameter end and drawing in of the small diameter end assures not only that the funnel material does not become too thin at its large diameter end but also that the small diameter end of the funnel does not have an excessively great thickness of material. Moreover, in this production method, overstretching of the funnel material at the large diameter end is avoided. Thus, with the production method of drawing in and expanding, a particularly favorable distribution of wall thickness and mass distribution at the opposite ends of the funnel is achieved.

Also, in order to avoid the problems encountered in connecting the funnel to the tubular central part of the catalytic converter housing, the large diameter end of the funnel is mounted on a connection bevel at the end of the tubular central part and is affixed there, preferably by soldering or welding. Alternatively, the tubular central part can be connected at its end to a connection bevel formed in the large diameter end of the funnel, although the bevel arrangement in the central tubular member is preferred. For manufacturing reasons, the connection bevel is preferably angled inwardly from the outer diameter of the central tubular member and is preferably produced by rolling the end of the central tubular member.

The connection bevel is preferably kept as short as possible, i.e., such that gap-free connection of the two parts is possible within the permissible manufacturing tolerances for the central tubular part and the funnel. The connection bevel is preferably formed at an angle of 10° to 70° and, most preferably 20° to 50°, to the longitudinal axis of the tubular central part since, with this geometry, relatively large manufacturing tolerances are possible with connection bevels which are not too long.

The funnel part which engages the connection bevel can likewise be designed with a connection bevel which is oriented in the opposite direction i.e. outwardly from the inner surface. This connection bevel preferably has an angle relative to the longitudinal axis of the tubular central part which is less than or equal to the angle of the inwardly directed connection bevel.

By providing such a connection bevel, not only is a diameter tolerance range at the funnel or the central tubular part advantageously compensated for but, at the same time, virtually no effective area at the end of the monolith is covered and, furthermore, the funnel geometry is simplified in contrast to the those of German Offenlegungsschrifts Nos. 34 30 398 and 34 30 399.

According to the invention, ceramic or metallic monoliths are preferably used as catalytic converter cores, it being possible for one or more monoliths to be accommodated in the tubular central part of the catalytic converter housing.

It is particularly preferred that the tubular central part in which the converter core is situated should be wound, i.e. is produced from a strip of sheet metal which, as described above, is wound around the converter core within an interlayer, in particular a mat, which supports the converter core within the tubular central part.

According to the invention, a funnel as described above is preferably arranged both on the inlet side and outlet side of the central tubular part.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
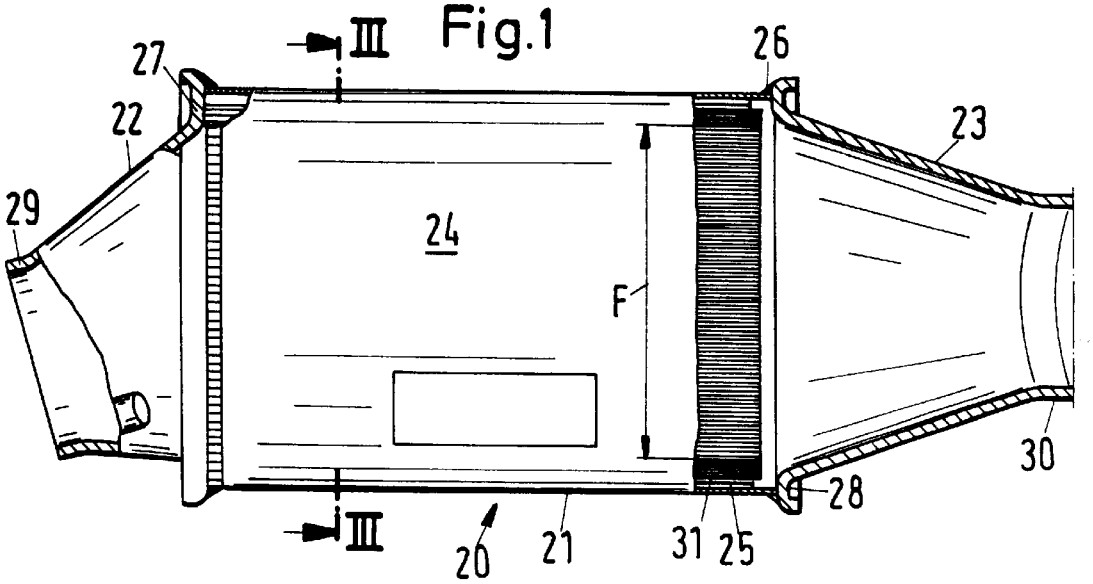
PRIOR ART Fig.1
FIG. 1 is a longitudinal sectional view showing a typical catalytic converter housing arrangement in accordance with the prior art.

FIG. 1 shows a conventional wound converter 20 in section, the converter being constructed from a tubular central part 21, an inlet funnel 22 and an outlet funnel 23. The tubular central part 21 is a sheet-metal jacket enclosing a catalytically coated monolith 24 with an expanded mat 25 between the monolith and the jacket.

In the manufacture of the wound converter 20, the expanded mat 25 is wound around the catalytically coated monolith 24 so that it supports the monolith. The sheet-metal jacket 21 is then placed on the expanded mat 25 and wound under tension around the expanded mat with a predetermined force to tension the unit. The tensioned sheet-metal jacket 21 is then tacked at the ends, thereby ensuring that the monolith 24 is seated in a fixed manner in the housing. In subsequent steps, two funnels 22 and 23, which are deep-drawn from sheet-metal blanks, are placed against the ends of the sheet-metal jacket 21 and affixed thereto by welds 26. To allow for tolerances, the funnels 22 and 23 have funnel collars 27 and 28 which extend at an angle of approximately 90° to the longitudinal axis of the central part 21 . The funnel collars 27 and 28 are produced from the corresponding sheet-metal blanks by clamping the corresponding edge of the blank when the funnels 22 and 23 are deep drawn.

As a result, the funnel rims or collars 27 and 28 have the largest material thickness of the funnels 22 and 23 since virtually no drawing of the material takes place there. This thickness greatly exceeds the thickness of the small diameter ends 29 and 30 of the funnels because the initial thickness of the sheet-metal blank must be chosen in such a way that, after deep-drawing, the small diameters are still thick enough to weld for the purpose of fitting and welding them to the inlet and outlet exhaust pipe sections (not shown) respectively. From the manufacturing point of view, there is thus the problem that, during deep-drawing, the wall thickness at the large diameter is equal to the wall thickness of the unworked piece sheet i.e. the sheet-metal blank. At the small diameter ends 29 and 30, on the other hand, the wall thickness is well below the wall thickness of the unworked piece, because of the drawing deformation. However, since a welded joint does not have to be made at the small diameter end, only a minimum wall thickness is required here. This particular minimum wall thickness is influenced only by the change in the dimensions of the unworked piece resulting from drawing, making it necessary to increase the wall thickness of the unworked piece and thus increasing the weight of the completed funnel, even though this is not required for the connection to the central part.

A further problem is produced by the funnel collars 27 and 28 which, depending on the radial position of the monolith 24 in its tolerance range within the tubular central member 21, may result in an overlap 31 of up to 15% of the total cross-sectional area F of the monolith 24.

Figure 2:
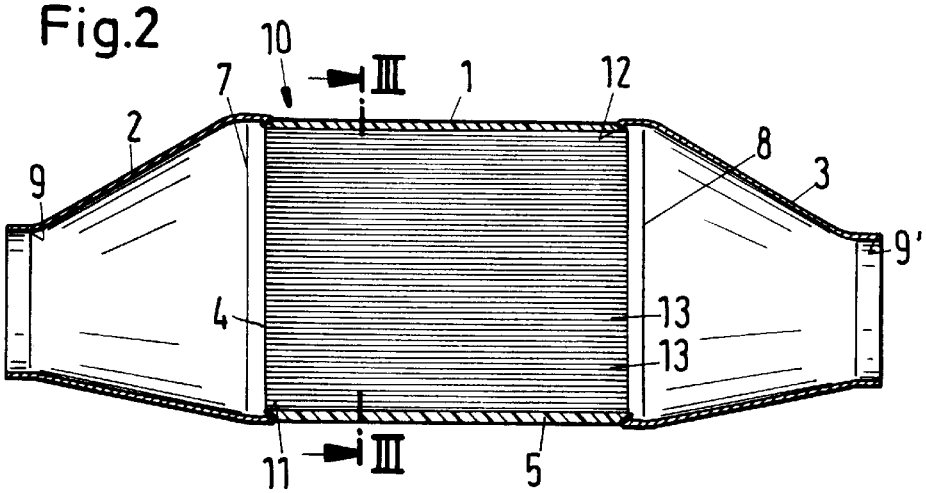
FIG. 2 is a longitudinal sectional view illustrating a representative embodiment of a catalytic converter housing arrangement with funnels made from tubular blanks in accordance with the invention.

These problems are avoided by providing a catalytic converter arrangement 10 according to the invention as shown FIG. 2. For the inlet funnel 2 and the outlet funnel 3, use is made of unworked pieces, or blanks, having the shape of a tube. To form each funnel a tubular member is expanded at one end and drawn in at the other end in two manufacturing operations, thereby giving rise to the large diameter ends 7 and 8 which have relatively small wall thicknesses compared to the wall thicknesses of the corresponding small diameter ends 9 and 9', but are nevertheless still weldable. Since the small wall thickness is at the large diameter ends 7 and 8, the tubular funnels 2 and 3 are considerably lighter than the prior art funnels 22 and 23, in which the small wall thickness is at the small diameter ends 29 and 30.

The tubular funnels 2 and 3 furthermore avoid the problem of connection to the tubular sheet-metal jacket 1 by providing a new connection arrangement. For this connection, the outer surface of the tubular sheet-metal jacket 1 is inclined inwardly at its ends at an angle of about 30° to the longitudinal axis of the tubular member, producing connection bevels 11 and 12. With these connection bevels 11 and 12, the diameter tolerances of the wound sheet-metal jacket 1 relative to the large diameter ends 7 and 8, respectively, of the tubular funnels 2 and 3 are compensated for. This makes it possible to weld the large diameter ends 7 and 8 to the connection bevels 11 and 12 so that they are joined parallel to the axis of the tubular central member 1. At the same time, the connection bevels 11 and 12 cover the expanded mat 5, preventing it from being eroded by the pulsating stream of exhaust gas. On the other hand, there is no overlapping of the ends of the funnels with the passages 13 of the converter core 4, making it possible to make full use of the effective cross section of the converter core.

Figure 3:
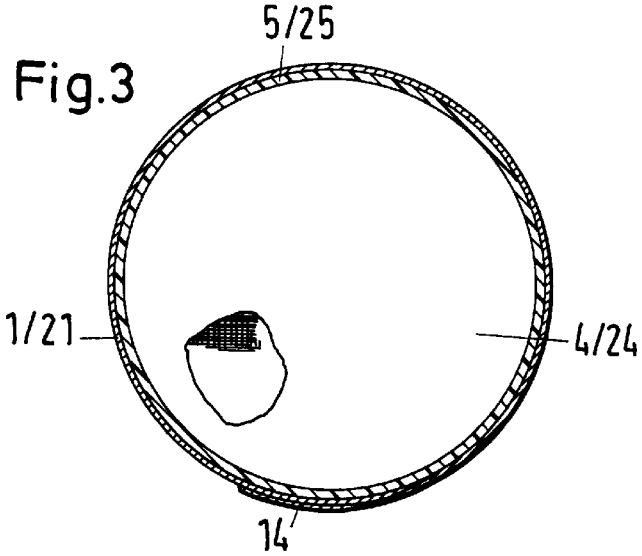
FIG. 3 is a cross-section through the central part of the catalytic converter housing arrangement of FIGS. 1 and 2 taken along the line III-III and looking in the direction of the arrows.

FIG. 3 shows that there is no difference in the overall cross section between the arrangements shown in FIGS. 1 and 2. In both cases, there is a wound sheet-metal jacket 21 and 1, respectively, which is welded with an overlap at a seam 14 to produce a tubular component. The converter core or monolith 4 or 24 is arranged within the sheet-metal jacket 1 or 21 and is supported against the sheet-metal jacket 1 or 21 by a mat 5 or 25. For the entire central part the only difference is the presence of the connection bevels 11 and 12, if these are formed in the sheet-metal jacket 1 rather than in the large diameter ends of the funnels.

It can furthermore be seen from the drawings that, according to the invention, as in the prior art, the funnels 2 and 3 can be formed asymmetrically. For this purpose, the unworked tubular blank is preferably drawn in at one end in a die and then expanded asymmetrically with respect to the longitudinal axis of the small diameter end to produce the large diameter end.

Although the invention has been described herein with reference to specific embodiments, many modifications and variations therein will readily occur to those skilled in the art. Accordingly, all such variations and modifications are included within the intended scope of the invention.

We claim:

1. A method for making a catalytic converter housing comprising:

forming a central tubular part containing a converter core and having an outer surface and an inner surface and an open end and formed at the open end with the outer surface inclined inwardly toward the inner surface to provide a connection bevel extending at an angle to the axis of the tubular part;

forming a funnel having an outer surface and an inner surface and a first end at which the inner surface of the funnel is inclined outwardly toward the outer surface of the funnel to provide a connection bevel engageable with the connection bevel in the tubular part and a second end; and attaching the outwardly inclined inner surface of the first end of the funnel directly to the inwardly inclined outer surface of the central tubular part.

2. A method according to claim 1 wherein the funnel is formed from a tubular blank.

3. A method according to claim 2 wherein the diameter of the second end of the tubular blank is reduced in a die.

4. A method for making a catalytic converter housing comprising:

forming a central tubular part containing a converter core and having an open end;

forming a funnel having a first end and a second end with a diameter smaller than that of the first end in which the thickness of a funnel wall at the first end is no more than 90% of the thickness of a funnel wall at the second end; and attaching the first end of the funnel directly to the open end of the central tubular part in which the funnel is formed from tubular material by expanding the diameter of the tubular material to form the first end of the funnel and reducing the diameter of the tubular material to form the second end of the funnel.

5. A method according to claim 4 wherein the diameter of the tubular material is expanded at the first end and reduced at the second end, respectively, in two separate steps.

6. A method according to claim 4 wherein the first end of the funnel is attached to the open end of the central tubular part by a connection bevel.

* * * * *